United States Patent [19]

Barabas et al.

[11] Patent Number: 4,662,286

[45] Date of Patent: May 5, 1987

[54] CONVERTIBLE TABLE

[75] Inventors: John Barabas, Carle Place; Ralph Bocella, Franklin Square, both of N.Y.

[73] Assignee: Castro Convertible Corporation, New Hyde Park, N.Y.

[21] Appl. No.: 818,498

[22] Filed: Jan. 13, 1986

[51] Int. Cl.[4] ..... A47B 85/00

[52] U.S. Cl. ..... 108/17; 108/145

[58] Field of Search ..... 108/17, 63, 79, 145

[56] References Cited

U.S. PATENT DOCUMENTS

| | | | |
|---|---|---|---|
| 124,281 | 3/1872 | Morstatt | 108/145 |
| 862,791 | 8/1907 | Bawden et al. | 108/145 |
| 2,582,791 | 1/1952 | Page | 108/145 X |
| 2,645,538 | 7/1953 | Segal | 108/145 |
| 2,678,858 | 5/1954 | Davis | 108/145 |
| 2,799,544 | 7/1957 | Hoppe | 108/145 |
| 2,846,282 | 8/1958 | Barker, Jr. | 108/63 |
| 3,688,705 | 9/1972 | Barabas | 108/17 |
| 4,303,018 | 12/1981 | Lehmann | 108/145 X |

FOREIGN PATENT DOCUMENTS

| | | | |
|---|---|---|---|
| 1161396 | 1/1964 | Fed. Rep. of Germany | 108/145 |

*Primary Examiner*—Peter A. Aschenbrenner
*Attorney, Agent, or Firm*—Pasquale A. Razzano

[57] ABSTRACT

A convertible table extendible from a low to a high position comprising a rectangular deck having cut-outs in its four corners, a frame surrounding the deck, folding leaves pivoted to the deck and constructed to fit within the frame when they are folded, four arms attached at their respective ends to a combination mounting bracket hinge and to one of four respective legs, and a mechanical linkage for raising and lowering the table by moving the top of the legs diagonally along rods mounted beneath the deck. When the table is in the high position, extensions fixed to the arms pass through the cut-outs in the four corners of the deck and raise the leaves up relative to the frame. The leaves can then be rotated and unfolded to form a full sized top.

4 Claims, 9 Drawing Figures

CONVERTIBLE TABLE

BACKGROUND OF THE INVENTION

The present invention relates, in general, to space-saving furniture. More particularly, it pertains to a convertible table which can be used in its upper extended position as a dining table or lowered to a low folded position wherein it is suitable as a cocktail or magazine table.

In many present day homes and apartments, space is at a premium and it is highly desirable to have furniture which is capable of serving more than one purpose. This fact accounts for the great popularity and widespread acceptance of convertible furniture such as sofa-beds, chairs and tables. A good example of convertible tables currently in use in the market is found in U.S. Pat. No. 2,846,282 which discloses a table which is extendible in height and size. The design of this table is basically sound, incorporating a relatively heavy base to provide the necessary stability and having the legs properly spaced apart and located beneath the table to permit a full number of people to sit comfortably without being obstructed by the table legs. The table is pleasing in appearance and the operating mechanism provided for raising and lowering the table has proved workable. To raise the table from a low to high position a lever is moved in approximately a 45° horizontal arc. The movement of the lever serves to disengage the locking mechanism and the table is raised with the help of tension springs mounted beneath the table. One drawback of this mechanism, however, is that when the table is in its lowered position and the table legs are raised off the ground, for example to move the table from one location to another, the operating mechanism can be unstable and could accidently activate causing the legs to move downward to their extended position.

OBJECTS OF THE INVENTION

It is, therefore, an object of this invention to provide a convertible table which is as sturdy and as convenient to use as an ordinary dining table but which, when not being so used, can be more easily folded to a much smaller size and height and used for other purposes.

Another object is to provide an improved simple, efficient and safe mechanism for controlling the height of such a table.

A further object is to provide such a table which can be raised to an upper position easily even though the table is relatively heavy and which can be positively locked into the lower position for safe and easy portability.

SUMMARY OF THE INVENTION

The present invention solves the problem associated with the operating mechanism for convertible tables. Moreover, the present invention provides an improved, almost completely automatic operating mechanism which can be securely locked in the lower position and which requires very little effort to activate and raise or lower the table to the desired position.

In accordance with one aspect of the present invention, a table top and frame are fitted with four slender legs whose feet are widely spaced for stability. These legs are each movable relative to the frame along independent tracks to allow for a sufficient extension of the table from a low to a high position and the requirement for convenient leg spacing. When extended to its full height the table can be folded to greater size by means of leaves ordinarily recessed within the table frame when the table is in the lower position.

In accordance with another aspect of the invention, an improved operating mechanism for the table is provided so that very little effort is required to unlock and raise the table from low to high position even though the table is relatively heavy. This operating mechanism is very simple to manufacture and operate. The mechanism is compact and does not detract from the pleasing appearance of the table.

In accordance with another aspect of the invention when the table is lowered for use as an ordinary cocktail table, the mechanism may be securely and positively locked in place so that the table can be lifted and moved from one position to another without the risk that the mechanism will activate accidentally and raise the table.

In accordance with another aspect of the invention, when the table is raised, the bottom surface of the leaves are raised to a point just below the top level of the frame by means of integral extensions built into the raising arms. In this position the table can be used as a small dining or card table and will present a good appearance. However, when the leaves are to be unfolded, they are automatically raised above the level of the frame by a very slight rotation and thereafter, when unfolded, are permitted to rest on the frame being locked in place. This automatic raising of the leaves above the level of the frame prevents wear on the top of the frame when the leaves are rotated and unfolded. This is an important feature from the standpoint of continuing good appearance.

BRIEF DESCRIPTION OF THE DRAWINGS

The above and other features and advantages of the present invention will become apparent upon consideration of the following detailed description of an illustrative embodiment thereof, especially when taken in conjunction with the accompanying drawings, wherein.

DETAILED DESCRIPTION OF A PREFERRED EMBODIMENT

Figure 1:
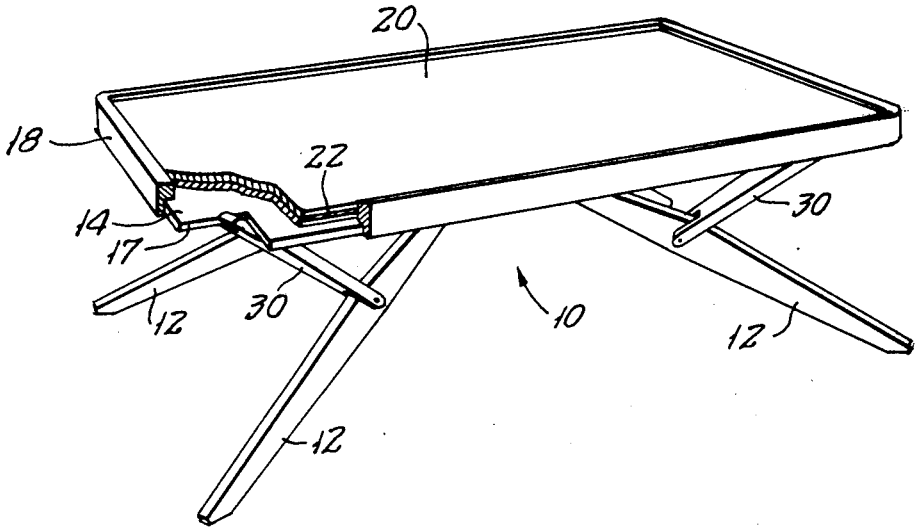
FIG. 1 is a perspective view of one embodiment of the invention showing a table in its low position and illustrating how the leaves thereof are recessed within the table frame.

Referring now to the drawings, and specifically to FIG. 1, a table 10 is shown in its lowered position. The table has four legs 12 which are pivoted at their tops to the table deck 14 by means of a unique mounting bracket 16 (shown in FIG. 3). Deck 14 is rigidly fixed to a peripheral frame 18 and has rectangular sections 17 removed from the four corners. As seen in FIG. 1, at the broken away left front corner of the frame, two leaves 20 hinged at 22 are recessed within the frame and lie against deck 14.

Figure 2:
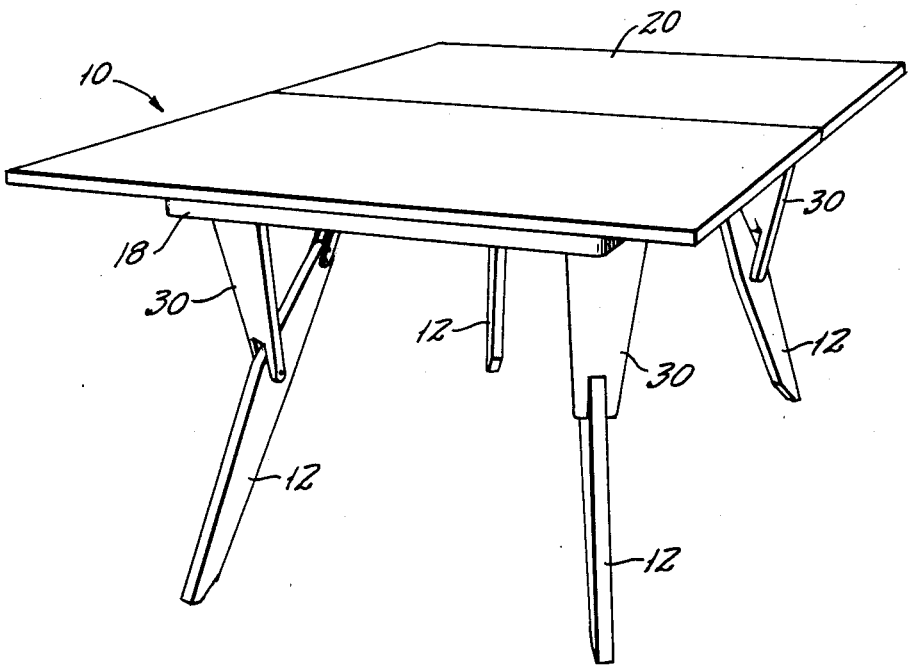
FIG. 2 is a perspective view of the table of FIG. 1 shown in its raised position, with its leaves extended.
Figure 3:
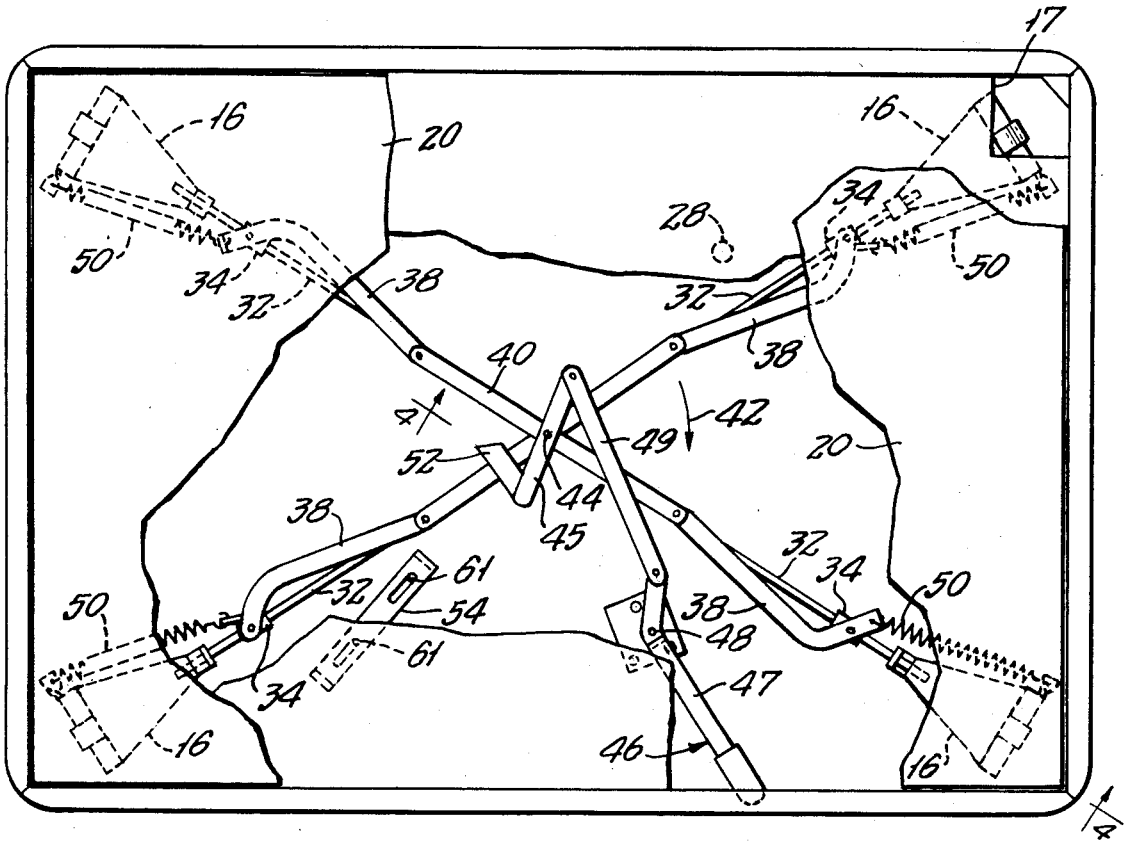
FIG. 3 is a top cut-away view of the table showing the position of the leg operating mechanism when the table is raised.

FIG. 2 shows table 10 in its raised position, with leaves 20 unfolded and rotated to extend the surface area of the table. These leaves rest on frame 18 and are rotatably locked in position, as will be described hereinafter. In order to move table 10 into its raised position an actuating lever 47 (described in detail below) is moved clockwise to disengage an over-center toggle formed by spider 40 and links 38. Biasing springs 50 then act to help the operator lift the table upward into its raised position. The upward movement of the deck 14 causes spider 40 to move into a second over-center toggle as shown in FIG. 3. In their raised position, the top ends of legs 12 have moved apart from their position in FIG. 1 to raise the height of the table. By comparing the spacing of feet of legs 12 shown in FIGS. 1 and 2, it is seen that the spacing is substantially the same in both the high and low positions of the table. Accordingly, when the table is raised, its feet need not be lifted free of the floor.

When table 10 is raised, leaves 20 are automatically raised relative to frame 18 by means of four extension arms 24 (FIG. 4) to a point just below the top edge 26 of frame 18. To bring the leaves into position for unfolding, they are first rotated around the floating pivot 28 (shown in FIG. 8 and 9 and in phantom in FIG. 3) which connects the bottom surface of the leaves 20 and the deck 14.

Figure 8:
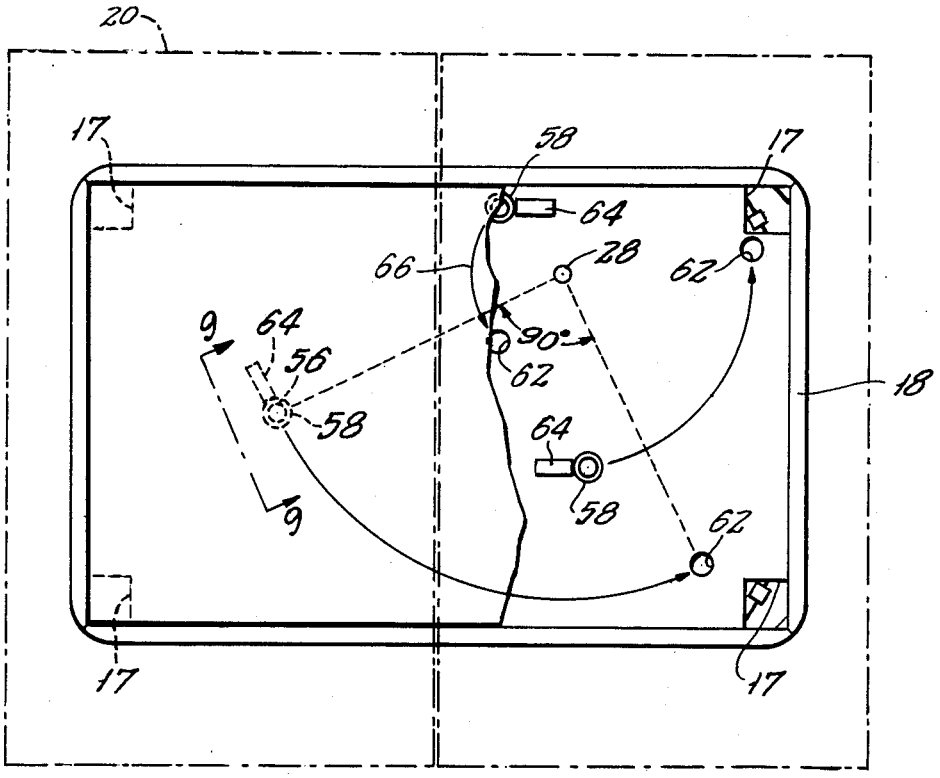
FIG. 8 is a top view of the table, with the table top surface removed, illustrating how the leaves are rotated and unfolded.

The first instant the leaves 20 begin to rotate they are further raised relative to the frame 18 so that their bottom surface moves slightly above the top 26 of frame 18. This supplemental raising is accomplished by the three glides 56, one of which is shown in section in FIG. 9, which are attached to the bottom side of the leaves 20 and which are positioned to mate respectfully with one of the three holes 58 in the deck 14. One of these holes is shown in section in FIG. 9 and their spacing is indicated in FIG. 8.

Figure 9:
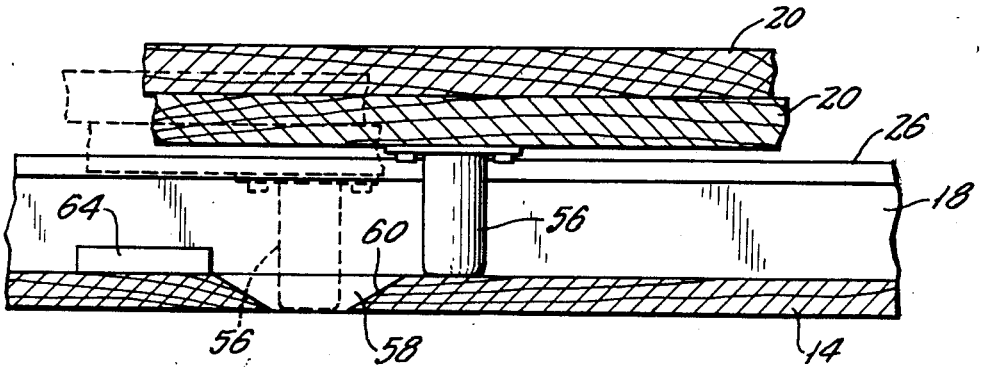
FIG. 9 is a section view taken along line 9—9 in FIG. 8 showing one of the glides which raises the bottom surface of the leaves above the top of the table frame.

As seen in FIG. 9, before leaves 20 are rotated relative to frame 18, and when the table is in its raised position, the bottom of each glide 56 extends into its respective hole 58 and is slightly below the level of the deck 14. In this condition the bottom surface of the leaves is slightly lower than the top of frame 18 (this position is shown in phantom in FIG. 9). As soon as the leaves 20 are rotated about their pivot 28, each glide 56 climbs up the leveled surface 60 in the forward edge of its respective hole 58 and raises leaves 20 just above top 26. Thereafter these leaves can be rotated to the phantom position shown in FIG. 8 without rubbing against the top of the frame. Just as the leaves reach this phantom position, glides 56 descend into the three holes 62 positioned as shown. This causes the leaves to rest against the top of frame 18 and prevents them from accidentally rotating. By providing a block 64 positioned adjacent glide holes 58 the leaves can only be rotated through the particular 90 degree arc indicated by arrow 66 shown in FIG. 8.

Figure 4:
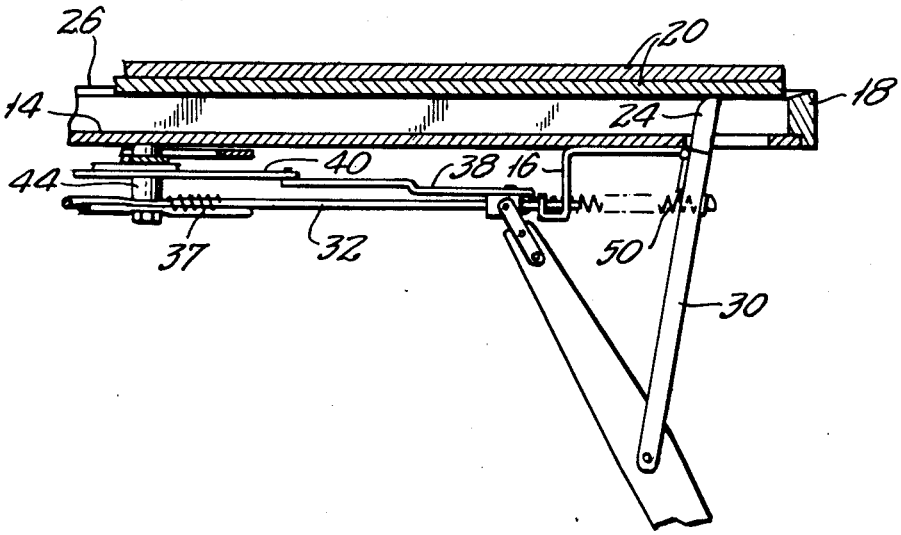
FIG. 4 is a sectional view taken along line 4—4 in FIG. 3 showing how the leaves of the table are automatically raised within the frame by the extension arms.
Figure 6:
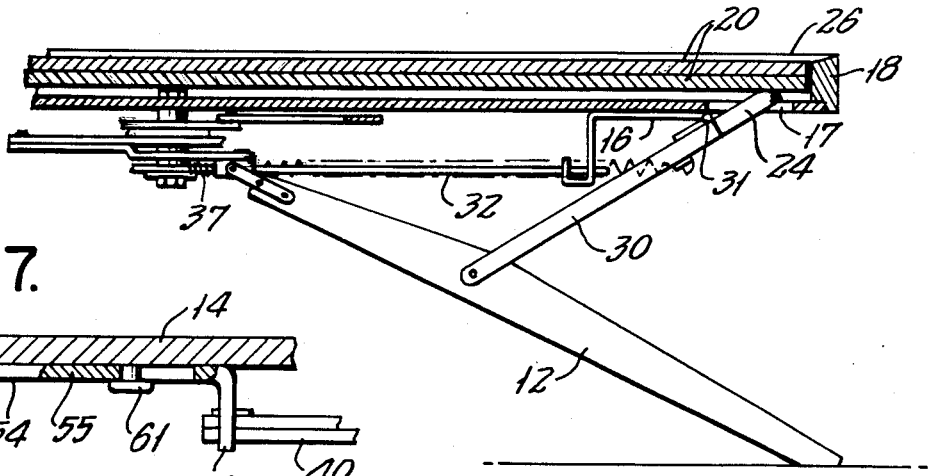
FIG. 6 is a section view taken along line 6—6 in FIG. 5 showing how the leaves are automatically lowered within the frame when the operating mechanism is in the low position.

As seen in FIGS. 4 and 6, each of the legs 12 is pivotally connected at a point intermediate its top and bottom to a respective one of the arms 30. These arms 30 are in turn pivoted to deck 14 by means of a unique mounting bracket 16. In raising table 10 from its low to its high position, the tops of legs 12 are moved along independent tracks 32 on the bottom of deck 14 toward the pivot points of arms 30. These tracks, as will appear, lie generally along the diagonals of the deck and frame and thus permit a substantially longer path of travel for the tops of the legs 12. This in turn permits the table 10 to be raised from its low to its high position without decreasing the spacing of the feet of the legs. Moreover, it makes possible the placement of these legs under the table so that a full number of people can be seated without inconvenience.

The mechanism which controls the travel of the tops of the legs 12 is shown in FIG. 3 in the position occupied when the table is raised. A portion of this mechanism is also shown in the sectional view of FIG. 4. As seen in these figures, the tops of legs 12 are pivoted to a respective one of four slides 34, these slides being movable between limits along radial tracks 32. The inner end of each of these tracks or rods is supported in a block 36 which is fastened to the bottom of deck 14 at its center. Compression springs 37 surround rods 32 and are positioned between block 36 and slides 34. The outer end of each rod is attached to one of the four arm mounting brackets 26 which are fixed in each corner of the deck 14 adjacent rectangular openings 17.

Pivoted to the top of each slide 34 is a link 38 which serves to draw the slide along its respective rod or track 32. These links are pivoted at their opposite ends to the arms of a rotatable spider 40. When this spider is rotated from the position shown in FIG. 3 in the direction of arrow 42, the slides 34 will be drawn toward the block 36 thus breaking the over-center toggle formed by the spider 40 and its connecting links 38. Downward force is then applied to the top of the table 10 to move it to its low position and to form a second over-center toggle in spider 40 shown in FIG. 5. This downward movement stretches tension springs 50 and compresses springs 37 to store potential energy to raise the table 10.

Spider 40 is pivoted at 44 to deck 14 and is adapted to be activated by a unique articulated linkage 46 which includes a link 45 fixed to spider 40 and pivoted with the spider at 44, an operating link or handle 47 pivoted intermediate its ends to a lever pivot bracket 48 fixed to the bottom of deck 14, and a connecting link 49 pivotedly connected between links 45 and 47. This articulated linkage provides an improved means of actuating the mechanism for lowering and raising table 10 in that minimal force is required to activate spider 40. The spider further includes a wedge or plate 52 secured to one leg of the spider 40 which, in the position shown in FIG. 3, has one end which bears against one end of link 45.

Figure 5:
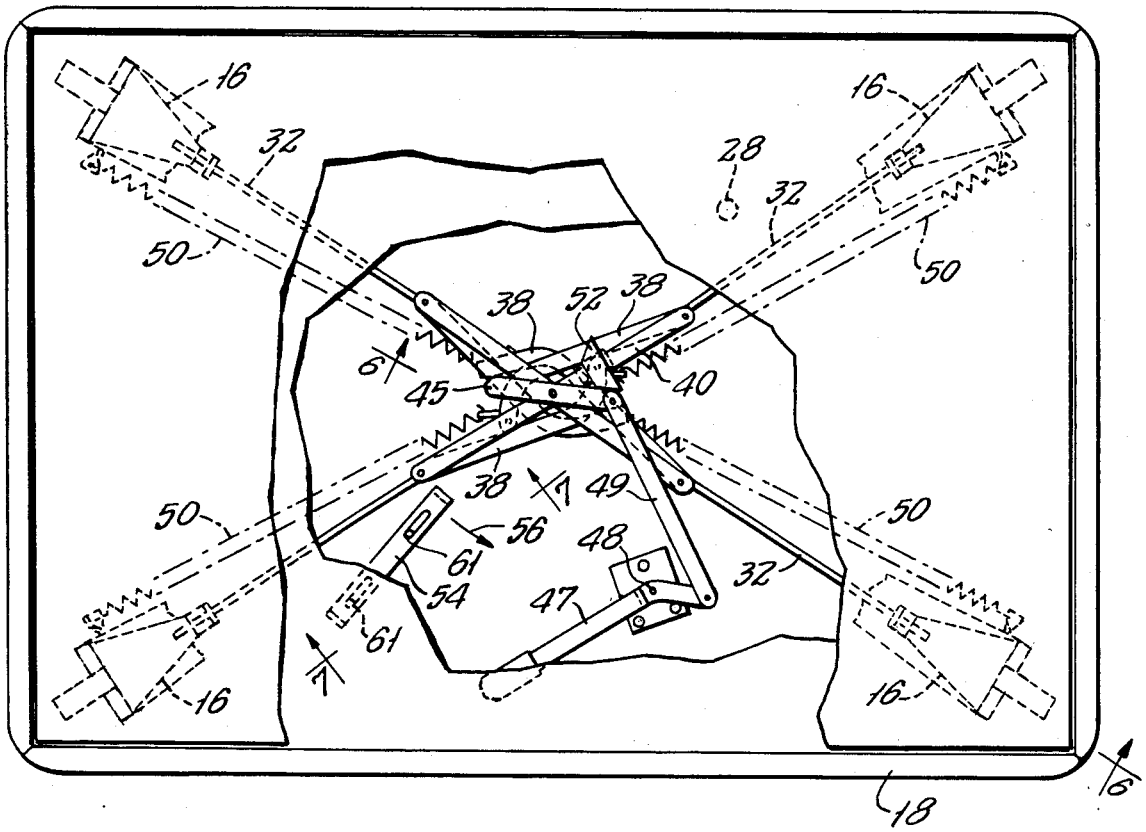
FIG. 5 is a top cut-away view of the table showing the operating mechanism when the table is in the lower position.

Links 38 are connected at their outer ends, as seen in FIGS. 3 and 5, to tension springs 50, which aid in holding the toggle, formed by spider 40 and links 38, over center and hence structurally locked. These springs also provide additional energy to help lift the table 10 to its raised position. Springs 50 are fixed at their opposite ends to arm mounting brackets 16 which are fixed beneath deck 14 at the points indicated.

Referring now to FIG. 4, the tops of arms 30 are pivoted to the deck 14 at the arm mounting bracket 16 by a hinge or pivot pin 31. Extending beyond the top of each arm 30 and through the rectangular cut-outs 17 in the deck 14 is an integral extension arm 24 which, in the position shown, pushes the leaves 20 up relative to frame 18. When the slides 34 are moving toward block 36, in lowering the table (shown in FIG. 6), the integral extension arms 24 are rotated about their associated mounting brackets 16, into and through cut-outs 17 thereby permitting the leaves 20 to move down within frame 18 and to rest next to deck 14.

When table 10 is in its low position, the leg operating mechanism occupies the position shown in FIGS. 5 and 6. Here, slides 34 and the top edges of legs 12 have moved along tracks 32 to their inner limit near the central pivot 44 and have compressed springs 37. In this position, spider 40 has rotated almost 180 degrees from its previous position and is locked in a second over-center toggle. As a result, one end of wedge 52 on spider 40 has moved from the position shown in FIG. 3 to the position shown in FIG. 5 wherein it bears on the inside of the other end of fixed link 45. Springs 50 are now tensioned much more than previously and the energy stored in them, along with the energy stored in compression springs 37, will help raise the table to its upper position when slide lock 54 (described hereafter) is withdrawn from the path of travel of the spider arms 40 and the articulated lever 47 is rotated a sufficient distance in the direction indicated the arrow 56 (FIG. 5) to unlock the toggle which is once again over center. In the over-center toggle position links 38 are interleaved with each other and the spider 40 as shown. With the slide lock 54 in a blocking position as shown in FIG. 5 the rotatable spider 40 is positively prevented from rotating counterclockwise a sufficient distance to break the over-center toggle even if the articulated lever arm 46 is moved. This manual locking device insures against the the accidental activation of the table lifting means, even when the table is moved while in its low position.

Figure 7:
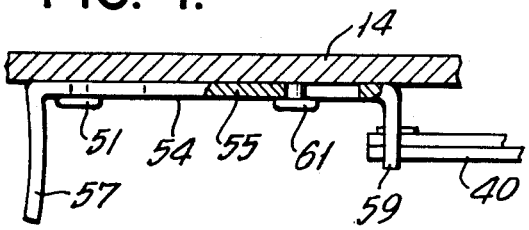
FIG. 7 is a side view in section showing the slide lock in position to block the rotatable spider linkage.

FIG. 7 shows a detailed side section of the slide lock 54 moved into position to block the rotation of one arm of the spider 40. The slide lock includes a locking bar 55 having a generally U-shaped configuration wherein one leg 57 defines an operating handle (for manually pushing the locking bar) and its other leg 59 is positioned to block spider 40. The bight of bar 55 has a pair of slots formed therein which receive pins 61 extending from the lower side of deck 14 to guide sliding movement of bar 55 between a locked position and a free position.

Those skilled in the art will readily appreciate that the slide lock device 54 only represents a preferred embodiment and many other equivalent locking means can be used.

Although an illustrative embodiment of the present invention has been described herein with reference to the accompanying drawings, it is to be understood that the invention is not limited to that particular embodiment and that various changes and modifications may be effected therein by those skilled in the art without departing from the spirit or scope of the invention.

What is claimed is:

1. A convertible table extendible from a low to a high position comprising a generally rectangular top, four combination arm-radial slide-spring mounting brackets fixed beneath said top near its corners, four arms having top and bottom ends, each being hinged adjacent their top end to a respective mounting bracket, four legs, each having opposed foot and top ends and being pivoted at an intermediate point between its foot and top end to the bottom end of one of said arms, drive means slidably connecting the top ends of said legs to the bottom of said top to move the top ends of said legs in unison closer to and away from the center of said rectangle and the corners thereof, said drive means comprising four slides each pivoted to the top of a respective leg, four rods each connected along the bottom of said top at said mounting brackets and lying generally diagonally along the underside of said top and coming together at their inner ends adjacent the center thereof, said slides being adapted to move along said rods, compression springs surrounding said rods and positioned to engage said slides when the table is in a low position, a rotatable spider positioned near the center of the underside of said top, movable links pivotally connecting said spider and said slides, four biasing springs each respectively connected between one of said slides and an associated mounting bracket, a lower pivot fixed beneath said top and an articulated activating linkage pivotally attached between the centerpoint of said spider and said lower pivot to initiate rotation of said spider allowing the slides to be driven radially along said rods to raise or lower said table; and locking means located beneath the table and movable between a free position and a lock position for blocking the rotation of said spider when said locking means is in the lock position; said locking means comprising a U-shaped slide bar having two axial slots in the bight thereof and movable between a free position and a lock position, said bar being slidably held in place beneath the table by pins received in said axial slots.

2. A convertible table as in claim 1 wherein said top includes a deck having cut-outs in its four corners, a frame and leaves adapted to be folded and recessed within said frame when said table is in low position, said four arms being hinged at their tops to the bottom side of said deck by means of the combination arm-radial slide mounting brackets positioned at points generally equidistant from the center of said deck.

3. A convertible table as in claim 2 wherein said arms each extend upward beyond the mounting brackets said extended portion being adapted to pass through the corresponding opening in said deck to raise said leaves relative to said frame when said table is in high position.

4. A table extendible from a low to a high position comprising a generally rectangular deck having cutouts formed in its four corners, a frame surrounding said deck and attached thereto, pivotally interconnected leaves positioned above said deck and adapted, when folded, to be recessed within said frame, brackets on said deck adjacent said cutouts, four relatively short arms having upper and lower ends and being hinged at their upper ends to respective brackets, four legs each having foot and top end portions and each being pivoted to a point intermediate its foot and top ends to the bottom end of one of said arms, four slides each pivotally connected to one of said legs, four rods lying generally diagonally along said rectangle and having outer ends fixed to respective brackets and coming together at their inner ends adjacent the center of said rectangle, said slides being adapted to move along said rods and to be held thereby, means to initiate movement of said slides along said rods in unison to raise and lower said table, locking means separate from said initiating means to safely lock said table in a desired position, and extensions integral to the top of said short arms, and adapted to move through said cutouts in said deck to elevate said leaves relative to said frame when said table is in said high position; said means to move said slides including a rotatable spider having four arms pivoted at the center of said rectangle beneath said deck, a wedge fixed to one arm of said spider, four links respectively connected between said spider and said slides, said spider and links cooperating, to form over-center toggles when said slides move closest to said corners and alternately, close to said center, an articulated activating linkage connected to said spider such that a short lateral movement of said linkage causes the arms of said spider to rotate and unlock said toggles, and a plurality of springs respectively connected between said slides and said brackets and adapted to store energy when said table is moved from high to low position; said articulated activating linkage comprising a pivot fixed to the underside of said deck, a handle rotatably mounted to said pivot at a point between the ends of said handle, an activating link pivotally mounted at the center of the spider and a connecting link pivotally attached between one end of said handle and said activating link such that when the handle is moved, the activating link bears against the wedge and rotates the spider; said locking means being movable between a free position and a lock position and is located beneath the deck to block the movement of said moving means when said locking means is in the lock position; said locking means comprising a U-shaped slide bar having two axial slots therein and movable between a free position and a lock position, said bar being slidably held in place beneath the table top by pins recorded in two axial slots.

* * * * *